US005605203A

United States Patent [19]

Chang

[11] Patent Number: 5,605,203

[45] Date of Patent: Feb. 25, 1997

[54] AUTOMATIC FOLDABLE EMERGENCY LADDER SYSTEM

[76] Inventor: Mu-Yi Chang, No. 7-7, Shihlin Rd., Touliu City, Yunlin Hsien, Taiwan

[21] Appl. No.: 520,779

[22] Filed: Aug. 30, 1995

[51] Int. Cl.[6] ..... E06C 9/00; E06C 1/00; E06C 1/383

[52] U.S. Cl. ..... 182/18; 182/19; 182/82; 182/93; 182/95; 182/152; 182/156; 182/163; 182/164

[58] Field of Search ..... 182/70, 196, 197, 182/198, 73, 95, 96, 195, 163, 164, 86, 74, 76, 99, 158, 160, 156, 18, 19, 82, 93, 152

[56] References Cited

U.S. PATENT DOCUMENTS

| | | | |
|---|---|---|---|
| 389,696 | 9/1888 | Fink | 182/18 |
| 446,433 | 2/1891 | Dalumi | 182/73 |
| 1,065,166 | 6/1913 | Murphy | 182/65 |
| 1,316,604 | 9/1919 | Turner | 182/18 |
| 2,513,835 | 7/1950 | Allen | 182/70 |
| 2,840,289 | 6/1958 | Murray | 182/70 |
| 3,847,246 | 11/1974 | Banner | 182/78 |
| 4,237,654 | 12/1980 | Landem et al. | 49/141 |
| 4,792,015 | 12/1988 | Brudi | 182/19 |
| 4,919,235 | 4/1990 | DelSavio | 182/18 |

FOREIGN PATENT DOCUMENTS

| | | | |
|---|---|---|---|
| 650616 | 2/1951 | United Kingdom | 182/198 |

*Primary Examiner*—Leslie A. Braun
*Assistant Examiner*—Donald J. Wallace
*Attorney, Agent, or Firm*—Merchant, Gould, Smith, Edell, Welter & Schmidt, P.A.

[57] ABSTRACT

An automatic foldable emergency ladder system for use in a building having a smoke detecting device includes an inverted L-shaped housing having a horizontal portion and a vertical portion and being securely mounted to a perimeter wall of a roof of the building; a control unit mounted in the horizontal portion of the housing and having at least one input port for receiving a signal from the smoke detecting device; an electrically powered driving device mounted in the horizontal portion of the housing and electrically connected to the control unit for receiving a signal therefrom and being activated/deactivated therefor; a spool unit rotatably mounted in the housing and driven by the driving device; a foldable ladder securely coupled to the vertical portion of the housing at one end thereof and having at least one wire which is secured to the spool means at one end thereof and an opposite end thereof is coupled to a free end of the foldable ladder such that the ladder can be folded/extended by the spool unit; and a display device electrically connected to the control unit for displaying the status of the system.

10 Claims, 5 Drawing Sheets

AUTOMATIC FOLDABLE EMERGENCY LADDER SYSTEM

BACKGROUND OF THE INVENTION

FIELD OF THE INVENTION

The present invention relates to emergency equipments and, more particularly, to an automatic foldable emergency ladder system for escaping urgently from a burning building.

SUMMARY OF THE INVENTION

The main object of the present invention is to provide an effective emergency ladder for people to safely escape from a burning building.

Another object of the present invention is to provide a foldable emergency ladder system which can be automatically lowered down when a signal is received from a smoke detecting device of the building to which the emergency ladder system is applied.

The above objects of the present invention are achieved by providing an automatic foldable emergency ladder system which includes an inverted L-shaped housing having a horizontal portion and a vertical portion and being securely mounted to a perimeter wall of a roof of the building; a control unit mounted in the horizontal portion of the housing and having at least one input port for receiving a signal from the smoke detecting device; an electrically powered driving means mounted in the horizontal portion of the housing and electrically connected to the control unit for receiving a signal therefrom and being activated/deactivated therefor; a spool means rotatably mounted in the housing and driven by the driving means; a foldable ladder securely coupled to the vertical portion of the housing at one end thereof and having at least one wire which is secured to the spool means at one end thereof and an opposite end thereof is coupled to a free end of the foldable ladder such that the ladder can be folded/extended by the spool means; and a display means electrically connected to the control unit for displaying the status of the system.

In accordance with one aspect of the present invention, the automatic foldable emergency ladder system further comprises a spare driving means mounted to the housing for manually actuating the spool means in case the electrically powered driving means is malfunctioning.

In accordance with another aspect of the present invention, the electrically powered driving means is an electrical motor having a driving shaft and a driving gear.

The spool means comprises a cylindrical body rotatably coupled to the housing, a gear coaxially coupled to one end of the body and driven by the driving means, and at least one wire regulating device for orderly winding the at least one wire of the ladder on the spool body.

In accordance with a further aspect of the present invention, the foldable ladder further comprises a plurality of step units pivotally and sequentially connected together. Each of the step units comprises a first hollow cross tube, a second hollow cross tube parallely spaced from the first cross tube, a pair of spaced apart first connecting rods pivotally connecting the first cross tube and the second cross tube, and a pair of spaced apart second connecting rods pivotally connecting the second cross tube to a first cross tube of an adjacent step unit.

Each of the first and second cross tube has two reinforcement bolts inserted into the cross tube from two opposite ends of the cross tube respective and extending a length over a position where a respective connecting rod of the first and second connection rods is coupled. Each of the step units has a ring inwardly extending from one of the first connection rods for the at least one wire passing through. Further, each of the first cross tube and the second cross tube has an anti-slip device mounted thereon.

In accordance with still a further aspect of the present invention, the automatic foldable emergency ladder further comprises a plurality of fastening means secured to a wall of the building along a passage of the foldable ladder when it is extended such that the extended ladder can be manually tightened to the fastening means to prevent the ladder from swaying.

In accordance with still a further aspect of the present invention, the spool means of the emergency ladder system further comprises at least one holding peg and the ladder system further comprises at least one fastening chain having a first end fixed to the housing and a second end passing over a bottom of the ladder when it is folded within the housing and engaging with the holding peg and arranged such that when the spool means rotates the second end of the chain will automatically disengage from the peg and allow the ladder to be extended.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
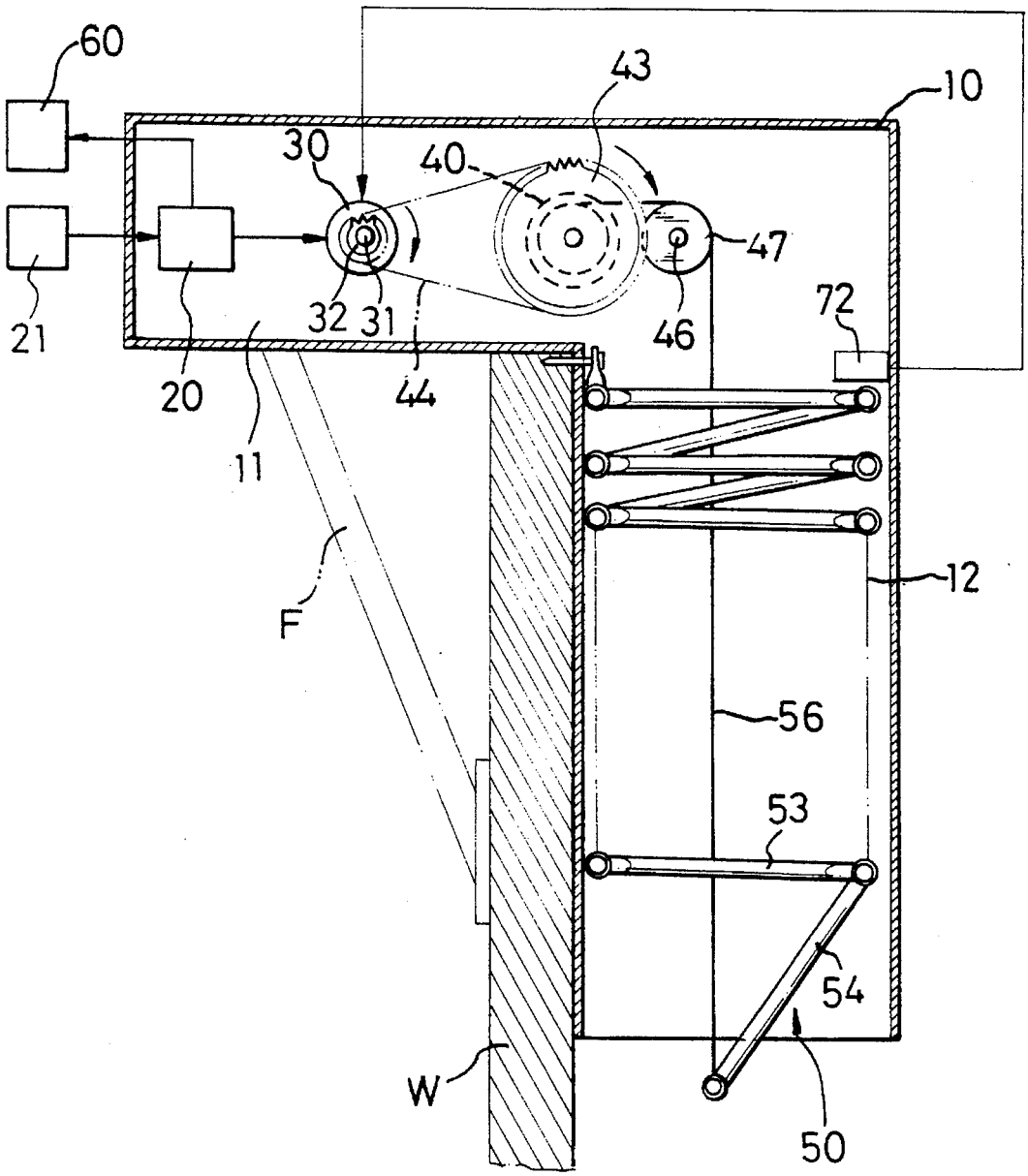
FIG. 1 is a left side cross-sectional view of an automatic foldable emergency ladder system in accordance with the present invention.
Figure 2:
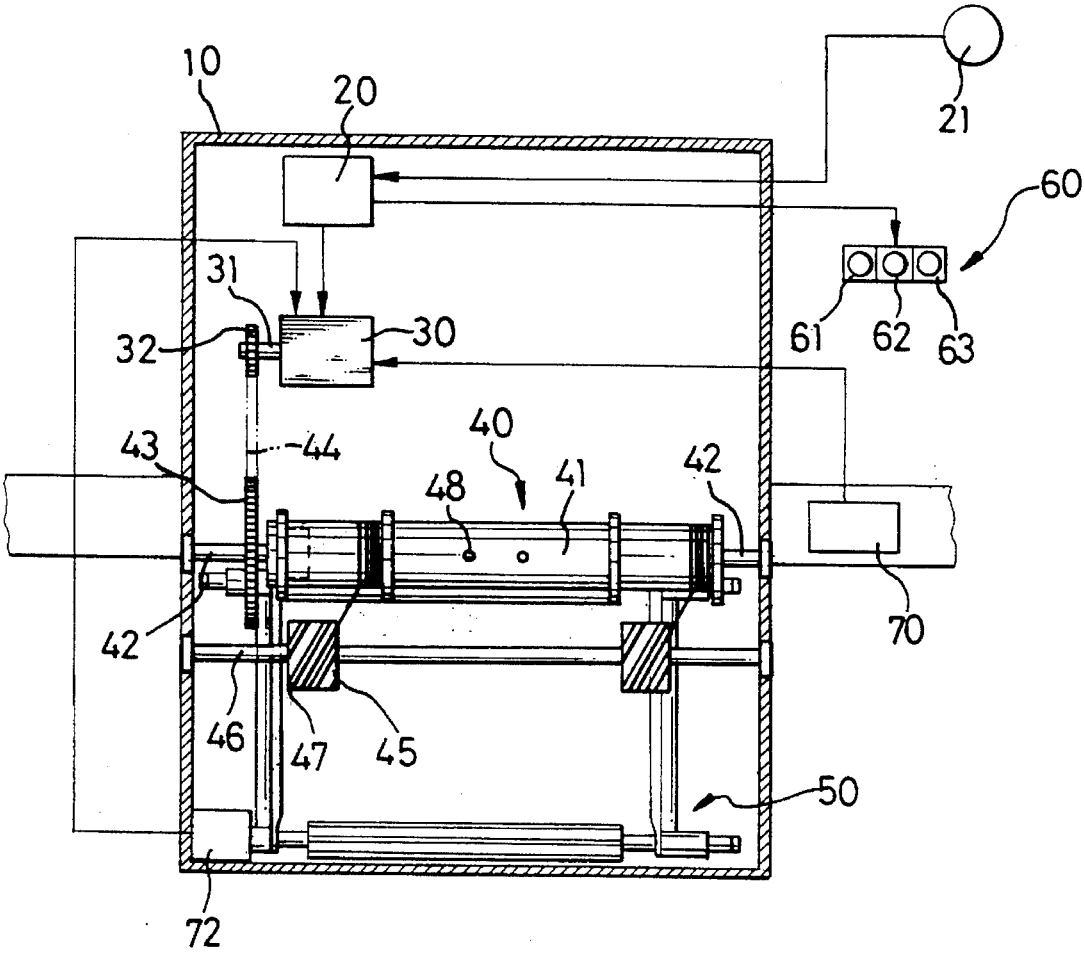
FIG. 2 is a top side cross-sectional view of an automatic foldable emergency ladder system as shown in FIG. 1.

Referring to the drawings and initially to FIGS. 1 and 2, the automatic foldable emergency ladder system in accordance with the present invention generally includes an inverted L-shaped housing 10, a primary control unit 20, an electrically powered driving means 30, a spool means 40, a foldable ladder 50, and a display means 60. The housing 10 has a horizontal portion 11 and a vertical portion 12 and is mounted to a perimeter wall W of the roof of a building to which the system 10 is to be applied via a frame F.

The primary control unit 20, which is schematically shown as a block, is a electrical circuit adapted to receive a signal from a smoke detecting device 21 of the building and output signals to the driving means 30 and the display means 60. The primary control unit 20 is mounted to the housing 10 at a position in the horizontal portion 11.

The electrically powered driving means 30, preferably, is a motor having a shaft 31 and a gear 32 coupled to a free end of the shaft 31. The driving motor 30 is electrically connected to the control unit 20 for receiving a signal therefrom and thereby being activated/deactivated. The driving motor 30 is mounted to the housing 10 in the horizontal portion 11. Preferably, the power supply of the driving motor 30 is independent from that used by the building, for instance, a heavy duty battery.

The spool means 40 comprises a cylindrical spool body 41 having a shaft 42 rotatably coupled to the housing 10, a gear 43 coaxially coupled to the shaft 42 and connected to the gear 32 of the driving motor 30 via a chain 44, a wire regulating device 45 having a shaft 46 mounted to the housing 10, and two wire regulators 47 are rotatably and spacedly mounted on the shaft 46. Preferably, the spool body 41 has two end portions and an intermediate portion having two pegs 48 outwardly extending from the intermediate portion.

Figure 3:
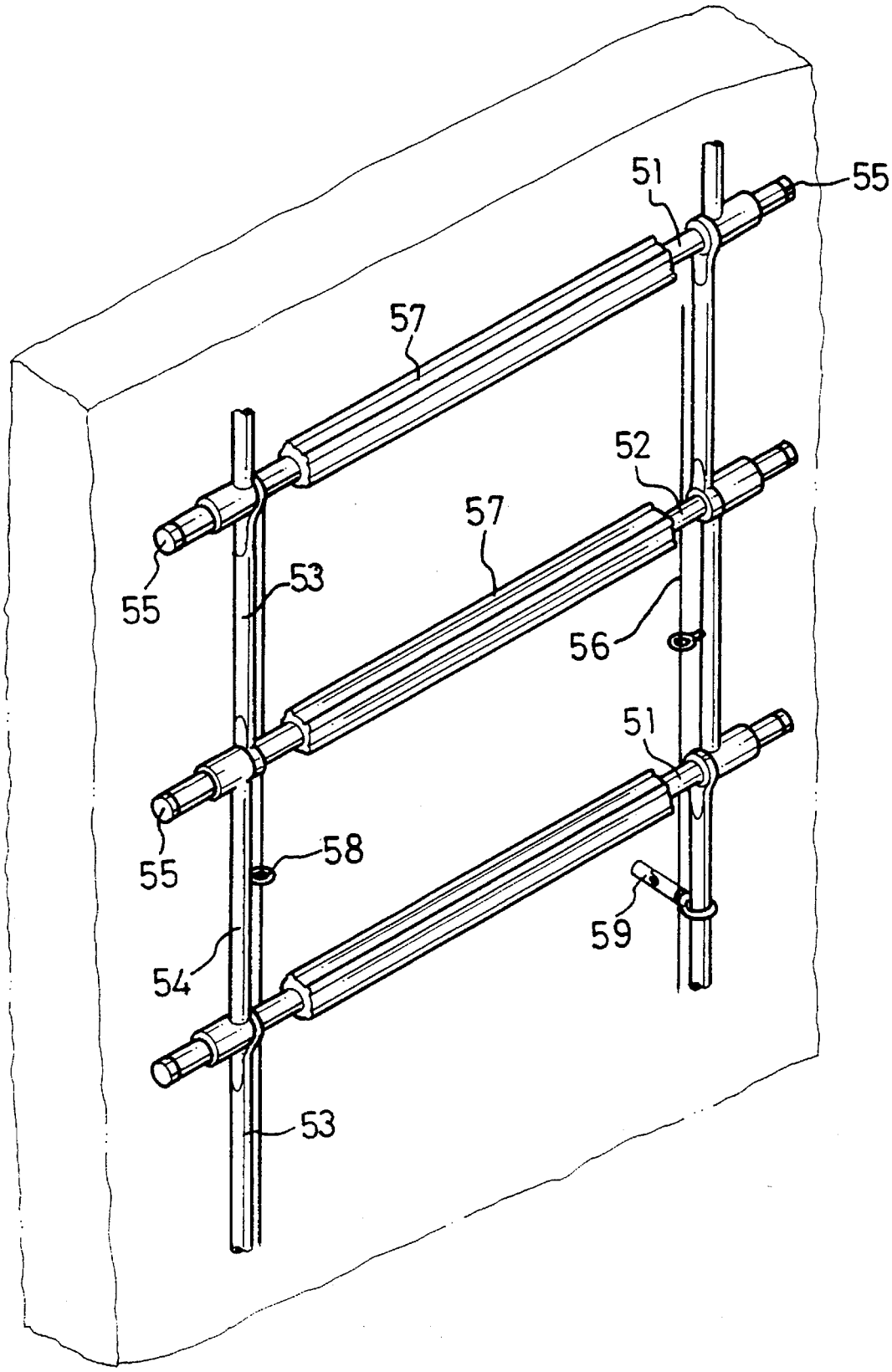
FIG. 3 is a perspective view, at a slightly enlarged scale, of a step unit of the foldable ladder of an automatic foldable emergency ladder system in accordance with the present invention.
Figure 4:
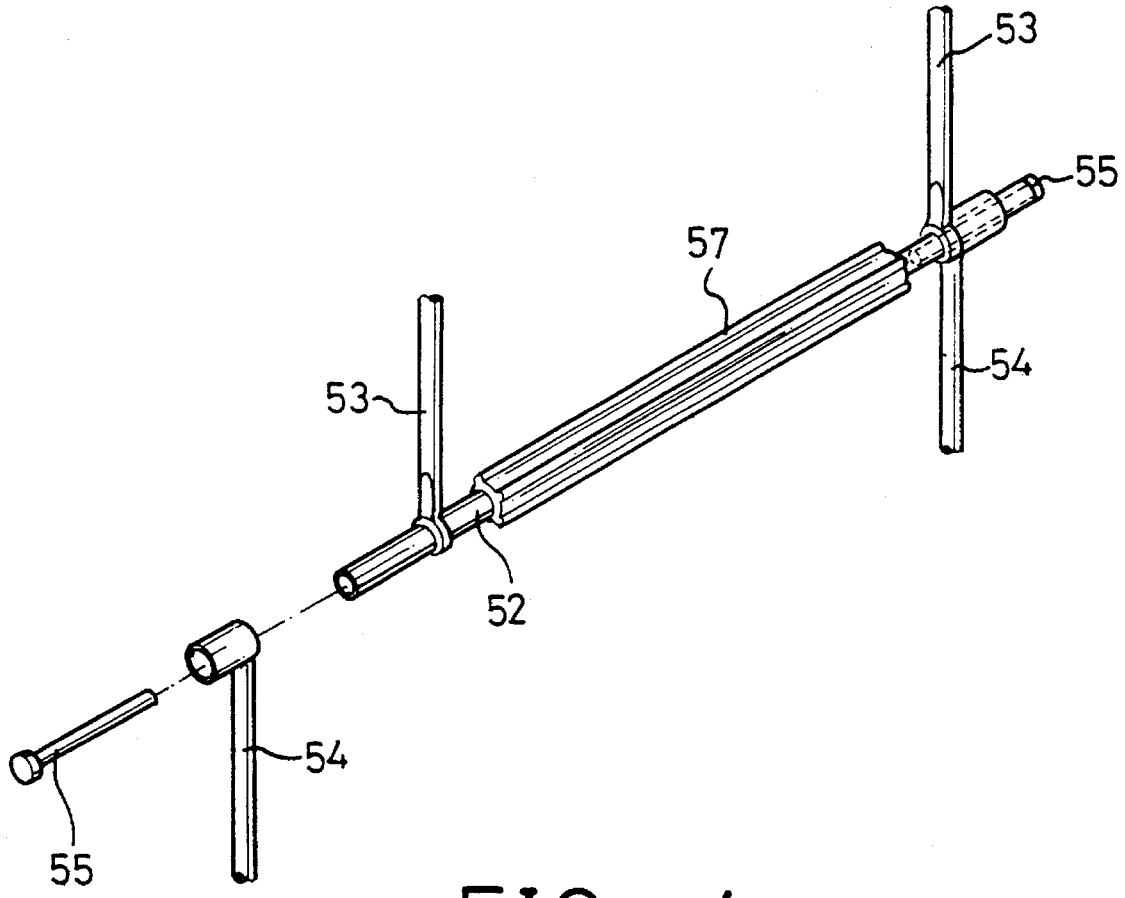
FIG. 4 is an exploded perspective view illustrating a detailed structural relationship of the step unit shown in FIG. 3.

Referring to FIGS. 3 and 4, the foldable ladder 50 includes a plurality of stare units sequentially and pivotally interconnected together. Each of the step unit comprises a first hollow cross tube 51, a second hollow cross tube 52 parallelly spaced from the first cross tube 51, a pair of spaced apart first connecting rods 53 fixedly connecting the first cross tube 51 and the second cross tube 52, and a pair of spaced apart second connecting rods 54 pivotally connecting the second cross tube 52 to a first cross tube 51 of an adjacent step unit. Further, each of the first and second cross tubes 51, 52 has two reinforcement bolts 55 respectively inserted thereinto from two opposite ends of the cross tube 51/52 and extending a length beyond a position where a respective connecting rod 53/54 is coupled, as clearly shown in FIG. 4. Moreover, the ladder 50 is securely mounted to the perimeter wall W of the building at one end thereof and has two wires 56 being coupled to a free end thereof. One end of the each of the two wires 56 which is opposite to the end coupled to the free end of the ladder 50 is coupled to a respective end portion of the spool body 41 via a respective wire regulator 45 (see FIGS. 1 and 2). Preferably, each of the first and second cross tubes 51, 52 has an anti-slip rubber sleeve 57 mounted thereon and each rod of the second pair of connection rods 54 has a ring 58 inwardly formed thereon for respective wire 56 to extend therethrough.

Referring back to FIGS. 1 and 2, the display means 60 is separately disposed outside the housing 10 and is electrically connected to the primary control unit 20. The display means preferably includes a low battery power indication light 61, an illuminating light 62 to provide sufficient light for people to see in the dark, and an alarm 63.

Figure 5:
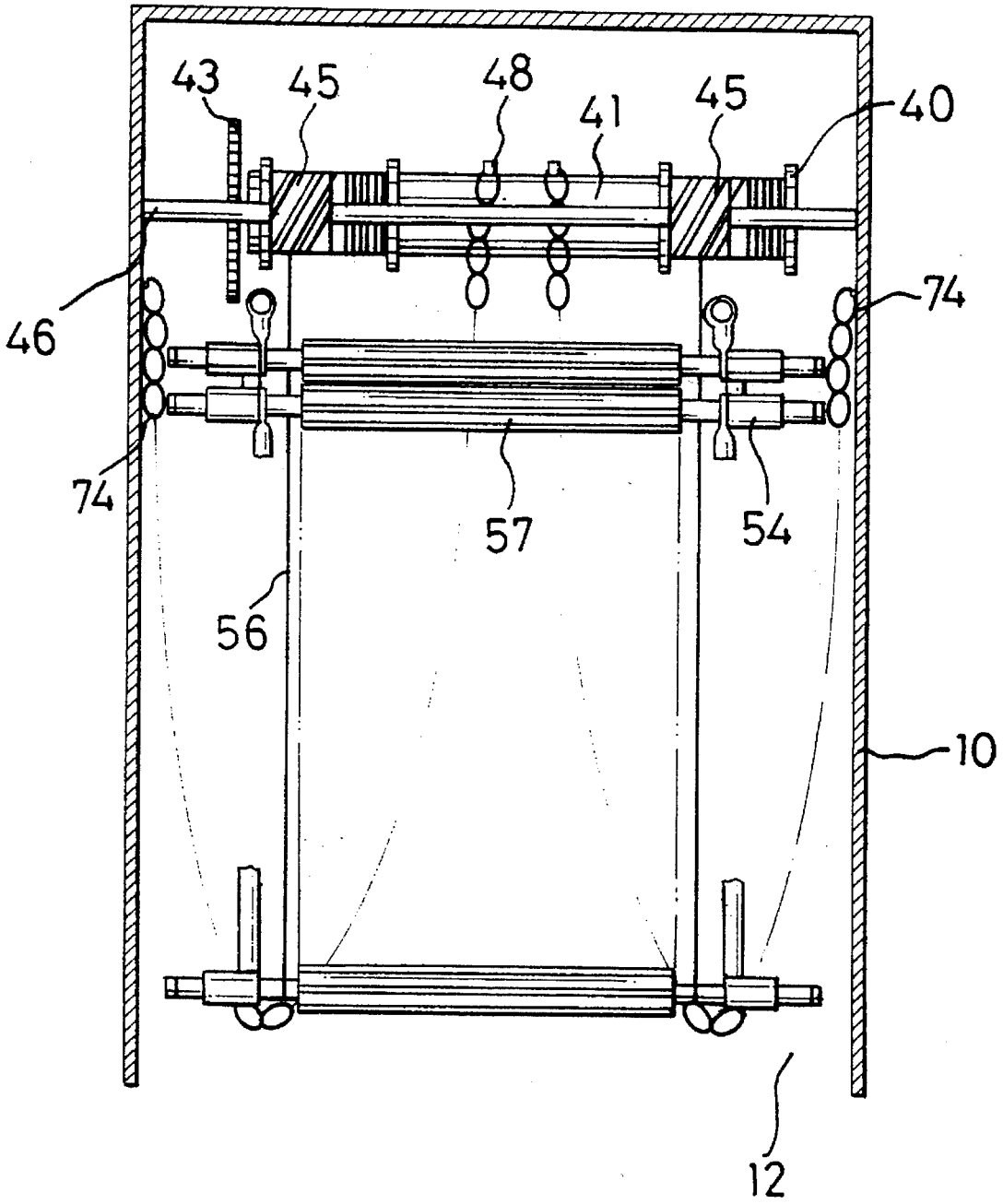
FIG. 5 is a front cross-sectional view of the automatic foldable emergency ladder system in accordance with the present invention, showing the ladder being completely folded and housed in the housing.

In one embodiment of the present invention, the automatic foldable emergency ladder system preferably has a manually operated control device 70 electrically connected to the driving motor 30 for manually activating/deactivating the driving means 30 in case the primary control unit 20 is malfunctioning. Further, a switch device 72 is disposed at a position in the housing 10 such that when the ladder 50 is completely folded within the vertical portion 12 of the housing 10 the switch device 72 will be activated to send a signal to the primary control unit 20 to stop the driving motor 30. Moreover, a plurality of fastening hooks 59 (see FIG. 3) are secured to a wall of the building along a travel area of the foldable ladder 50 when it is extended such that the ladder can be manually attached to the fastening hooks 59 by the first person crawling down the ladder to prevent the ladder 50 from swaying in the air. Referring to FIG. 5, the ladder system, preferably, further includes two fastening chains 74, each of which has a first end fixed to the housing 10 and a second end passing over a bottom of the ladder 50 when the ladder 50 is folded within the housing 10 and engaging with the respective holding peg 48 of the spool body 41 to share a major portion of the weight of the ladder 50 from the wires 56.

In use, when the primary control unit 20 receives a signal from the smoke detecting device 21 of the building, the primary control unit 20 will send a signal to the display means 60 to turn on the illuminating light 62 and the alarm 63. At the same time, the primary control unit 20 will send a signal to the driving motor 30 to cause the driving motor 30 to activate the spool means 40 to rotate. When the spool body 41 is rotated, the second end of each of the fastening chains 74 will automatically disengage from the peg 48 and allow the ladder 50 to be unfolded until it reaches ground and then the motor is stopped in a conventional way, such as use of a micoswitch. When the ladder 50 is to be folded, the supplemental control unit 70 is used to send a signal to the driving motor 30 to cause the spool means 40 to wind up the wires 56 to fold the ladder 50 until an upper step unit of the ladder 50 contacts the switch device 72 to send a signal to the driving motor 30 to stop it.

Although the invention has been explained in relation to its preferred embodiment, it is to be understood that many other possible modifications and variations can be made without departing from the spirit and scope of the invention as hereinafter claimed.

I claim:

1. An automatic foldable emergency ladder system for use in a building having a smoke detecting device comprising:

an inverted L-shaped housing having a horizontal portion and a vertical portion and adapted to be securely mounted to an external wall of a roof of the building;

a primary control unit mounted in the horizontal portion of the housing and having at least one input port for receiving a signal from the smoke detecting device;

an electrically powered driving means mounted in the horizontal portion of the housing and electrically connected to the primary control unit for receiving a signal therefrom and being activated/deactivated thereby;

a spool means rotatably mounted in the housing and driven by the driving means;

a foldable ladder adapted to be securely coupled to the wall of the building at one end of said foldable ladder and having at least one wire which is secured to the spool means at one end thereof and an opposite end thereof is coupled to a free end of the foldable ladder such that the ladder can be folded/extended by the spool means; said foldable ladder being secured within said L-shaped housing when said foldable ladder is in its folded position, and a display means electrically connected to the control unit for displaying the status of the system.

2. The automatic foldable emergency ladder system as claimed in claim 1 further comprising a supplemental control unit electrically connected to the driving means for manually activating/deactivating the driving means in case the primary control unit is malfunctioning.

3. The automatic foldable emergency ladder system as claimed in claim 1 wherein the electrically powered driving means is an electrical motor having a driving shaft and a driving gear.

4. The automatic foldable emergency ladder system as claimed in claim 1 wherein the spool means comprises a cylindrical body rotatably coupled to the housing, a gear coaxially coupled to one end of the body and driven by the driving means, and at least one wire regulating device for orderly winding the at least one wire of the ladder on the spool body.

5. The automatic foldable emergency ladder system as claimed in claim 1 wherein the foldable ladder further comprises a plurality of step units pivotally and sequentially connected together, each of the step units comprising a first hollow cross tube, a second hollow cross tube parallely spaced from the first cross tube, a pair of spaced apart first connecting rods fixedly connecting the first cross tube and the second cross tube, and a pair of spaced apart second connecting rods pivotally connecting the second cross tube to a first cross tube of an adjacent step unit.

6. The automatic foldable emergency ladder system as claimed in claim 5 wherein each of the first and second cross tubes has two reinforcement bolts inserted into the cross tube from two opposite ends of the cross tube respective and extending a length over a position where a respectively connecting rod of the first and second connection rods is coupled.

7. The automatic foldable emergency ladder system as claimed in claim 5 wherein each of the step units has a ring inwardly extending from one of the second connection rods for the at least one wire to extend therethrough.

8. The automatic foldable emergency ladder system as claimed in claim 5 wherein each of the first cross tube and the second cross tube has an anti-slip device mounted thereon.

9. The automatic foldable emergency ladder system as claimed in claim 1 further comprising a plurality of fastening means adapted to be secured to the wall of the building along a passage of the foldable ladder when it is extended such that the extended ladder can be manually tightened to the fastening means to prevent the ladder from swaying in the air.

10. The automatic foldable emergency ladder system as claimed in claim 1 wherein the spool means further comprises at least one holding peg and the ladder system further comprises at least one fastening chain having a first end fixed to the housing and a second end passing over a bottom of the ladder when it is folded within the housing and engaging with the holding peg and arranged such that when the spool means rotates the second end of the chain will automatically disengage from the peg and allow the ladder to be extended.

* * * * *